US005733144A

United States Patent [19]

Tsuji et al.

[11] Patent Number: 5,733,144

[45] Date of Patent: Mar. 31, 1998

[54] ELECTRICAL CONNECTOR WITH FLEXIBLE RETAINING PIECE

[75] Inventors: Masanori Tsuji; Motohisa Kashiyama, both of Shizuoka, Japan

[73] Assignee: Yazaki Corporation, Tokyo, Japan

[21] Appl. No.: 647,322

[22] Filed: May 9, 1996

[30] Foreign Application Priority Data

May 24, 1995 [JP] Japan ..... 7-124858

[51] Int. Cl.[6] ..... H01R 13/422

[52] U.S. Cl. ..... 439/595

[58] Field of Search ..... 439/595, 752

[56] References Cited

U.S. PATENT DOCUMENTS

| | | | |
|---|---|---|---|
| 3,990,759 | 11/1976 | Crowe | 439/595 |
| 4,705,337 | 11/1987 | Maeda | 439/595 |

FOREIGN PATENT DOCUMENTS

| | | | |
|---|---|---|---|
| 3438036 | 4/1986 | Germany | 439/595 |
| 61-119285 | 7/1986 | Japan . | |
| 2-36180 | 3/1990 | Japan . | |
| 2-61782 | 12/1990 | Japan . | |
| 5-36767 | 5/1993 | Japan . | |

*Primary Examiner*—Neil Abrams

*Attorney, Agent, or Firm*—Morgan, Lewis & Bockius LLP

[57] ABSTRACT

A terminal retaining member is defined by a flexible retaining piece which can be bent. The flexible retaining piece is extended in an arch-like, bent manner between opposite sides edges of a retaining hole open to an outer surface of a connector housing. After a terminal is inserted into a terminal receiving chamber, the flexible retaining piece is pressed to be received into the retaining hole, thereby retaining the terminal.

10 Claims, 7 Drawing Sheets

ELECTRICAL CONNECTOR WITH FLEXIBLE RETAINING PIECE

BACKGROUND OF THE INVENTION

1. Field of the Invention

This invention relates to a connector housing of an electric connector for connection to electric wiring of an automobile or the like, in which each terminal is retained against rearward withdrawal in a double manner by a lance, provided in a terminal receiving chamber, and a terminal retaining member.

2. Background

A conventional connector having terminal retaining members is disclosed, for example, in Unexamined Japanese Utility Model Publication No. 2-36180, and includes a connector housing K as shown in FIGS. 10 and 11.

In the connector housing K, a terminal f, inserted into each terminal receiving chamber b in a housing body a, is retained in a double manner by a lance c, provided in the terminal receiving chamber, and a retaining plate e pivotally connected to an edge of a retaining hole d formed in the housing body a, as shown in FIG. 12.

For mounting the terminal f in the terminal receiving chamber b, the terminal f is first inserted into the terminal receiving chamber, with the retaining plate e held in an open condition, so that the terminal f is primarily retained by the lance c. Then, when the retaining plate e is closed to be fitted into the retaining hole d, a projected portion $e_1$ of the retaining plate e engages a shoulder $f_1$ of the terminal f, thereby retaining the terminal f in a secondary manner.

However, each retaining plate e of the connector housing K is pivotal about an axis g (see FIGS. 10 and 11) extending perpendicular to a direction of fitting of the housing body a, and the retaining plate e can be opened and closed, facing in this fitting direction. Therefore, if the retaining plate e inadvertently fails to be closed when fitting the connector to a mating connector, the retaining plate e strikes against the mating connector, and is unduly raised and damaged.

SUMMARY OF THE INVENTION

With the above problem in view, it is an object of this invention to provide a connector housing in which there are provided improved terminal retaining members which will not project from an outer surface of the housing, and hence will not be damaged.

The above object of the invention has been achieved by a connector housing wherein each terminal is retained in a double manner by a lance, formed on an inner surface of a terminal receiving chamber, and a terminal retaining member inserted into the terminal receiving chamber through a retaining hole formed through a wall of the connector housing; in which the terminal retaining member is defined by a flexible retaining piece which is bendable; and the flexible retaining piece is connected in a bent manner between opposite side edges of the retaining hole extending substantially parallel to the terminal receiving chamber.

Preferably, the flexible retaining piece is formed integrally with the connector housing, and has hinges formed respectively at its opposite ends and central portion.

Preferably, the flexible retaining piece has a pair of opposed, retaining slanting surfaces formed respectively on opposite sides of the hinge at the central portion thereof.

Preferably, the retaining holes are formed respectively for the terminal receiving chambers, and the flexible retaining piece extends between the opposite side edges of each of the retaining holes.

In the connector housing of the present invention, the flexible retaining piece can be received into the retaining hole, and the flexible retaining piece is engaged with the terminal, received in the terminal receiving chamber, thereby retaining the terminal. Therefore, when the terminal is thus retained, the flexible retaining piece does not project from the connector housing, and therefore the flexible retaining piece will not be damaged by an external force, and will not hinder wiring, so that the connector housing can be of a small size.

The flexible retaining piece is connected between the opposite side edges of the retaining hole extending parallel to the terminal receiving chamber, and axes of the hinges of the flexible retaining piece extend parallel to the direction of fitting of the connector housing, and the opposite ends of the flexible retaining piece are connected to the connector housing through the hinges, respectively. Therefore, even if an external force acts on the projected flexible retaining piece when fitting the connector housing relative to a mating connector, the flexible retaining piece will not be further raised, and hence will not be damaged. The opposed, retaining slanting surfaces are formed respectively on the opposite sides of the central hinge of the flexible retaining piece, and therefore when the flexible retaining piece is received in the retaining hole, the two retaining slanting surfaces are held in intimate contact with each other, so that the flexible retaining piece is stably held in a bend condition.

If any terminal is in a half-inserted condition in the terminal receiving chamber, the flexible retaining piece can not be fully received into the retaining hole, and the connector housing can not be fitted relative to the mating connector, so that such a half-inserted condition of the terminal can be easily found. Where the plurality of retaining holes are provided respectively for the terminal receiving chambers, and the flexible retaining piece is provided for each of the retaining holes, the condition of the flexible retaining piece for each terminal receiving chamber can be confirmed, and any terminal receiving chamber in which the terminal is half inserted can be easily found.

DETAILED DESCRIPTION OF THE PREFERRED EMBODIMENTS

Figure 1:
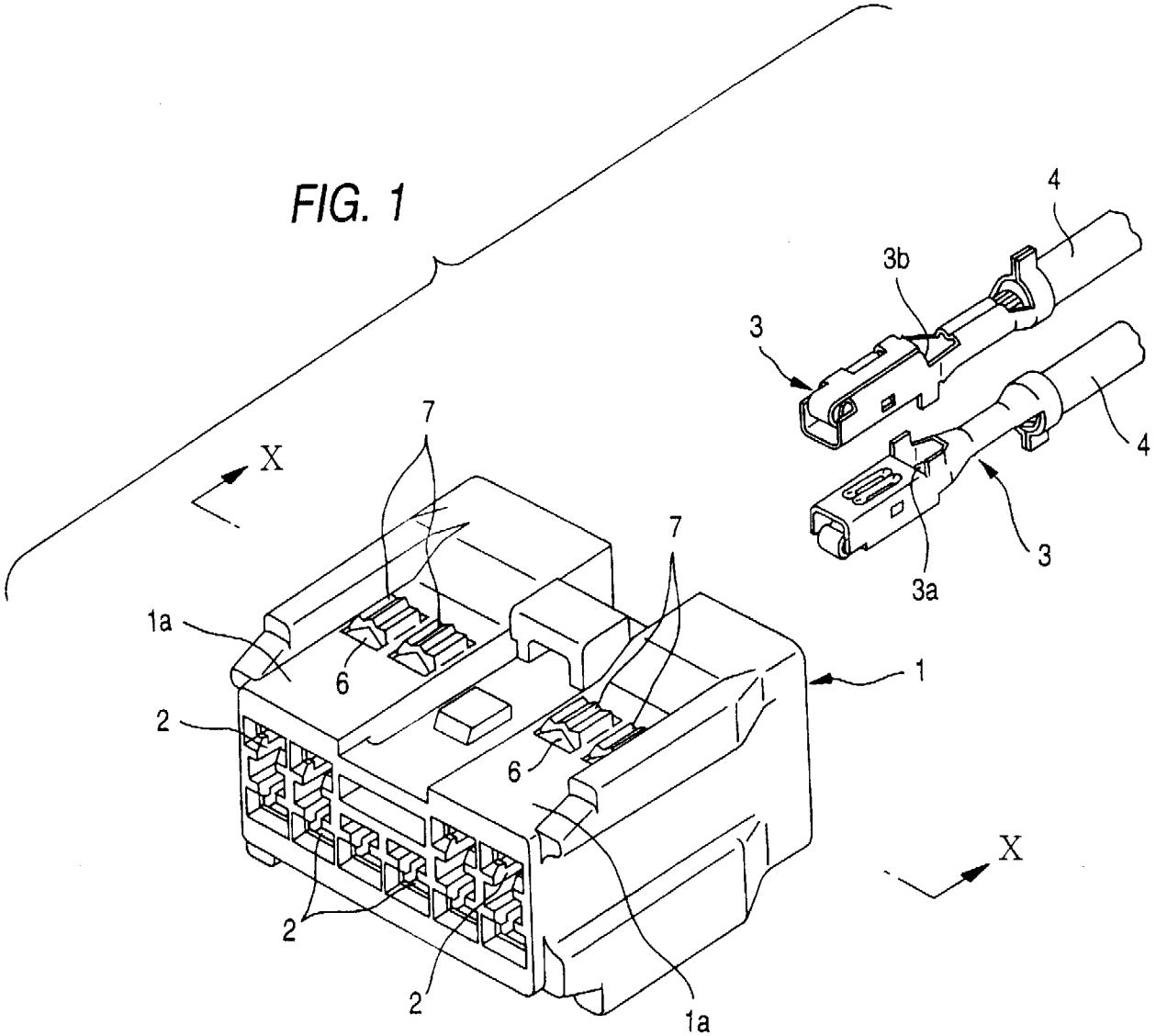
FIG. 1 is a perspective view, showing a preferred embodiment of a connector housing of the present invention, as well as female terminals used therein.

FIG. 1 is a perspective view of a preferred embodiment of a connector housing 1 of the present invention.

The connector housing 1 is molded of an electrically-insulative synthetic resin, and has a plurality of terminal receiving chambers 2 arranged in upper and lower rows. Each terminal receiving chamber 2 is adapted to receive a female terminal 3 therein, and a wire 4 is connected to the terminal 3.

Figure 2:
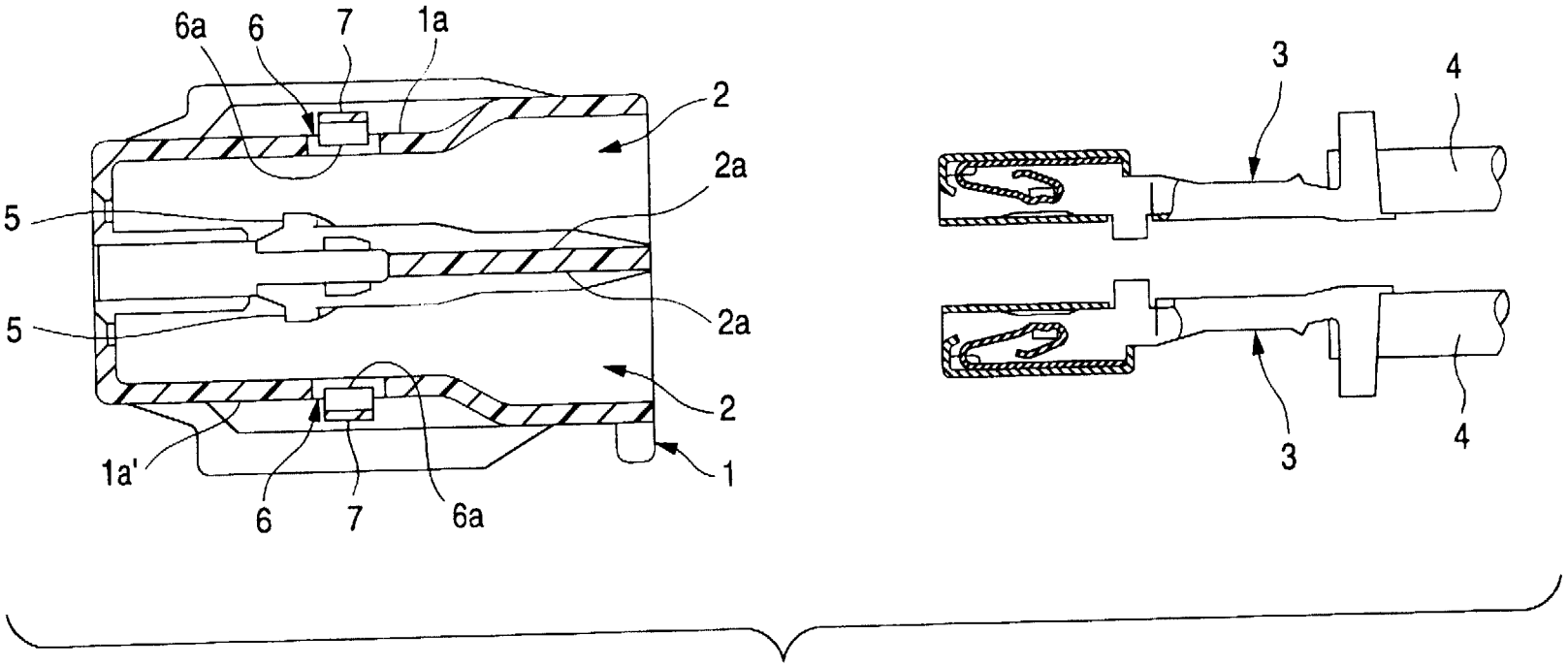
FIG. 2 is a vertical cross-sectional view of the connector housing of FIG. 1.

As shown in FIG. 2, a lance 5 is formed on an inner surface 2*a* of the terminal receiving chamber 2 for upward and downward movement, and can be engaged in a retaining hole 3*a* in the terminal 3 to thereby primarily retain the terminal 3. A plurality of retaining holes 6 are open to upper and lower outer surfaces 1*a* and 1*a'* of the connector housing 1, and are disposed in registry with the terminal receiving chambers 2, respectively. A terminal retaining member can be fitted in each of the retaining holes 6 to retain the terminal 3 in a secondary manner.

Figure 3:
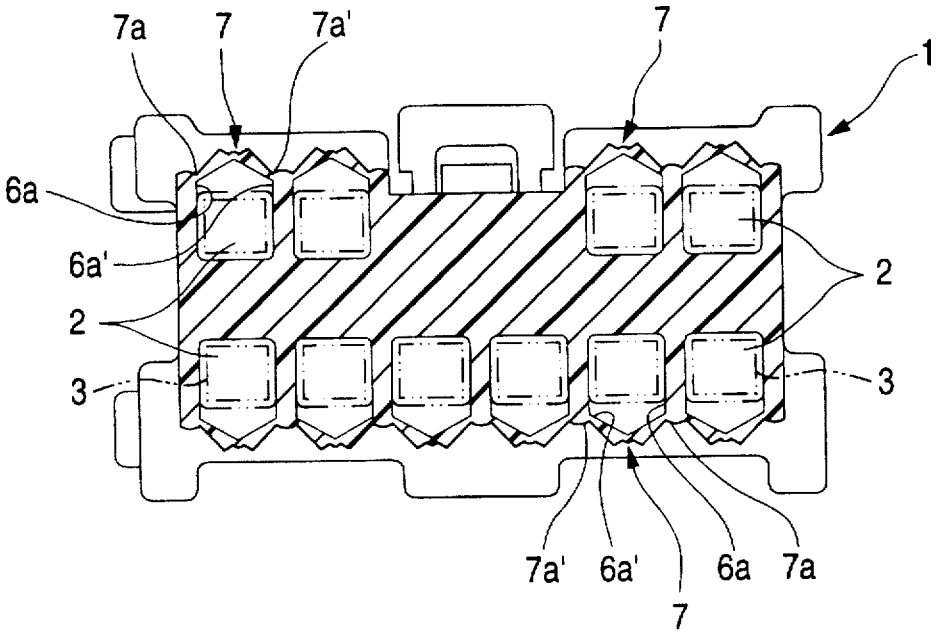
FIG. 3 is a cross-sectional view of the connector housing taken along the line X—X of FIG. 1.

As shown in FIG. 3, the retaining hole 6 has a rectangular shape, and has opposite side edges 6*a* and 6*a'* extending parallel to the terminal receiving chamber 2. A flexible retaining piece 7 serving as the terminal retaining member is connected in a bent manner between the opposite side edges 6*a* and 6*a'* through hinges 7*a* and 7*a'*. Axes of pivotal movement of the hinges 7*a* and 7*a'* extend in a direction of fitting of the connector housing 1.

Figure 4:
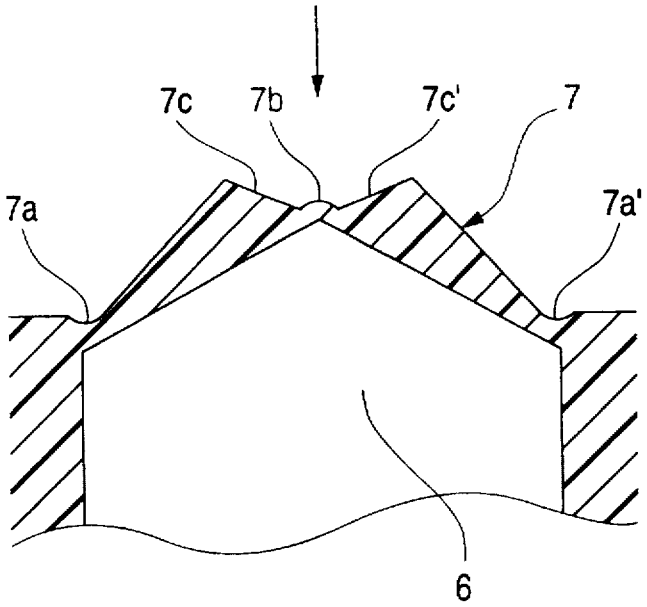
FIG. 4 is a front-elevational view showing the structure of a flexible retaining piece shown in FIG. 3.
Figure 5:
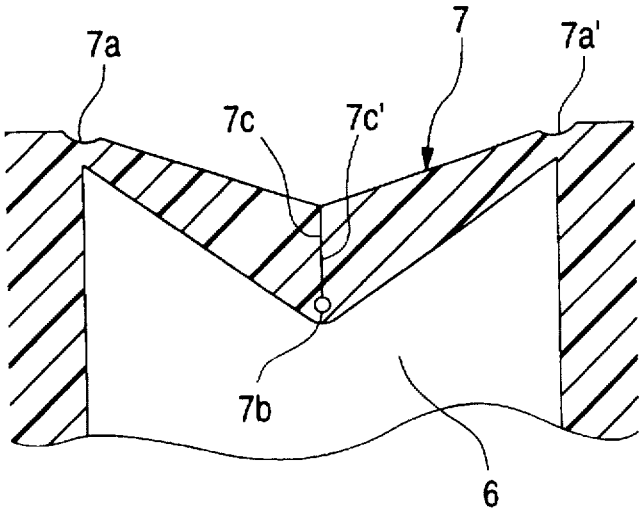
FIG. 5 is a front-elevational view showing the flexible retaining piece of FIG. 4 which is pressed to be received into a retaining hole.

The flexible retaining piece 7 is formed integrally with the connector housing 1, and has the hinges 7*a* and 7*a'* of a reduced thickness formed respectively at its opposite ends, and also has a hinge 7*b* of a reduced thickness at its central portion, as shown in FIG. 4. Retaining slanting surfaces 7*c* and 7*c'* are formed on opposite sides of the central hinge 7*b*, respectively. When that portion of the flexible retaining piece 7 including the central hinge 7*b* is pressed in a direction indicated by an arrow, the flexible retaining piece 7 is received into the retaining hole 6, and at this time the flexible retaining piece 7 is bent reversely, so that the retaining slanting surfaces 7*c* and 7*c'* are brought into intimate contact with each other, and this reversely-bent condition is maintained, as shown in FIG. 5.

Figure 6:
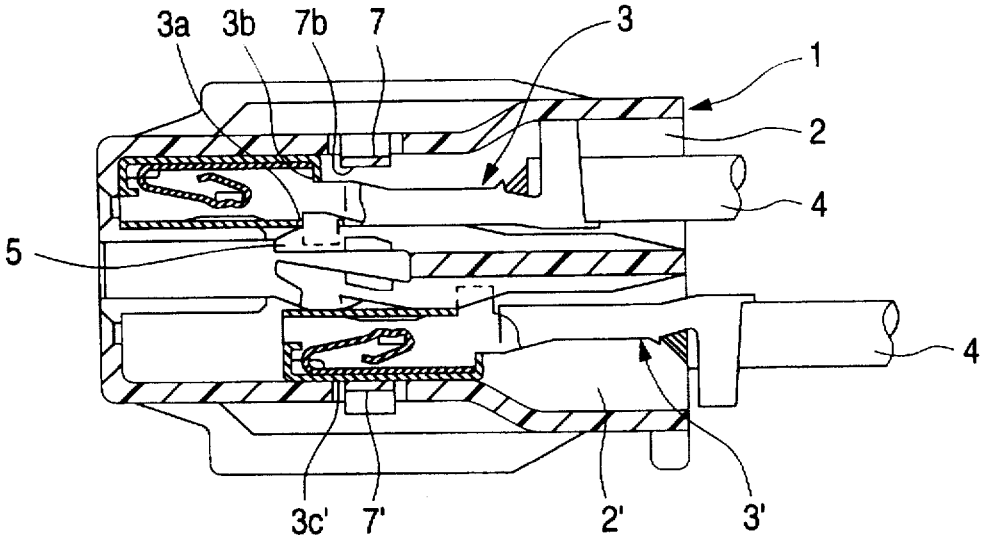
FIG. 6 is a cross-sectional view showing a condition in which the terminals are inserted into respective terminal receiving chambers of FIG. 1.
Figure 7:
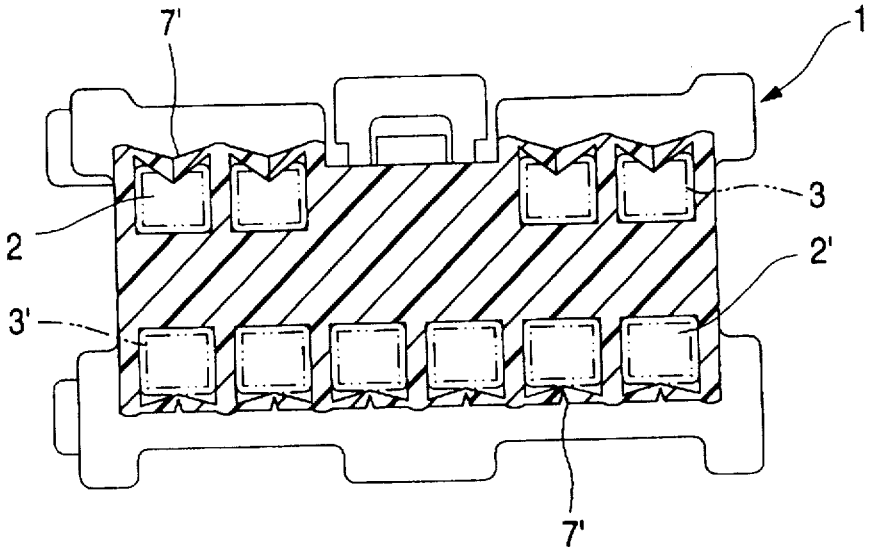
FIG. 7 is a cross-sectional view showing the flexible retaining pieces shown in FIG. 4.

When the terminal 3 is inserted into the terminal receiving chamber 2, the lance 5 is first fitted in the retaining hole 3*a* in the terminal 3, thereby primarily retaining the terminal 3. Then, when the flexible retaining piece 7 is pressed to be introduced into the retaining hole 6 as shown in FIGS. 6 and 7, a side edge portion of the flexible retaining piece 7 engages a shoulder 3*b* of the terminal 3, thereby positively preventing rearward withdrawal of the terminal 3.

Figure 8:
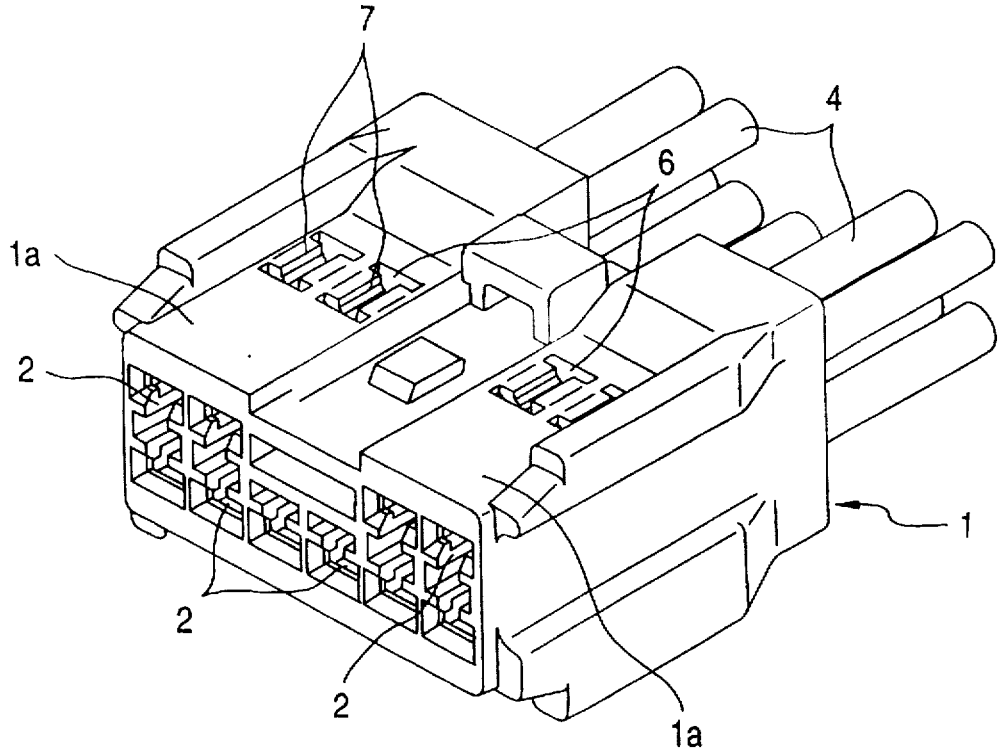
FIG. 8 is a perspective view showing the appearance of the connector housing of FIG. 1.

On the other hand, if the terminal 3' is in a half-inserted condition as in the terminal receiving chambers 2' in the lower row (FIGS. 6 and 7), the flexible retaining piece 7', when pressed, abuts against a back portion 3*c'* of the terminal 3', and therefore is prevented from being introduced into the retaining hole 6. Therefore, the operator can easily find that the terminal 3' is in a half-inserted condition. FIG. 8 is a perspective view of the connector housing 1, showing a condition in which the flexible retaining pieces 7 are received in the respective retaining holes 6 to retain the terminals 3.

Figure 9:
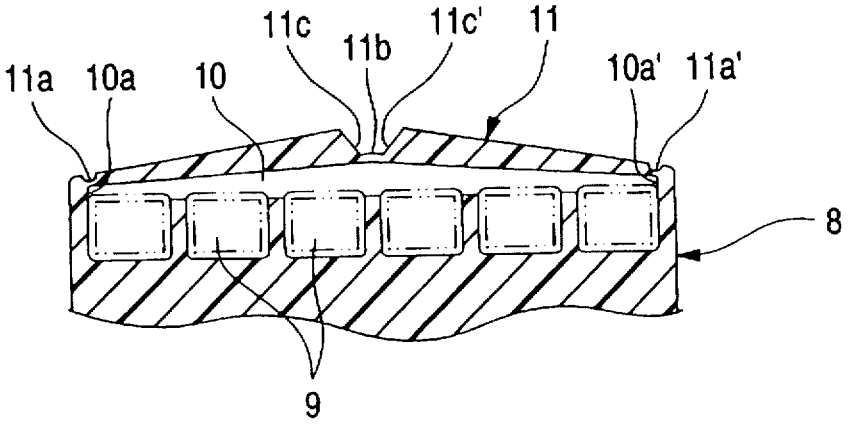
FIG. 9 is a cross-sectional view of another preferred embodiment of a connector housing of the invention.
Figure 10:
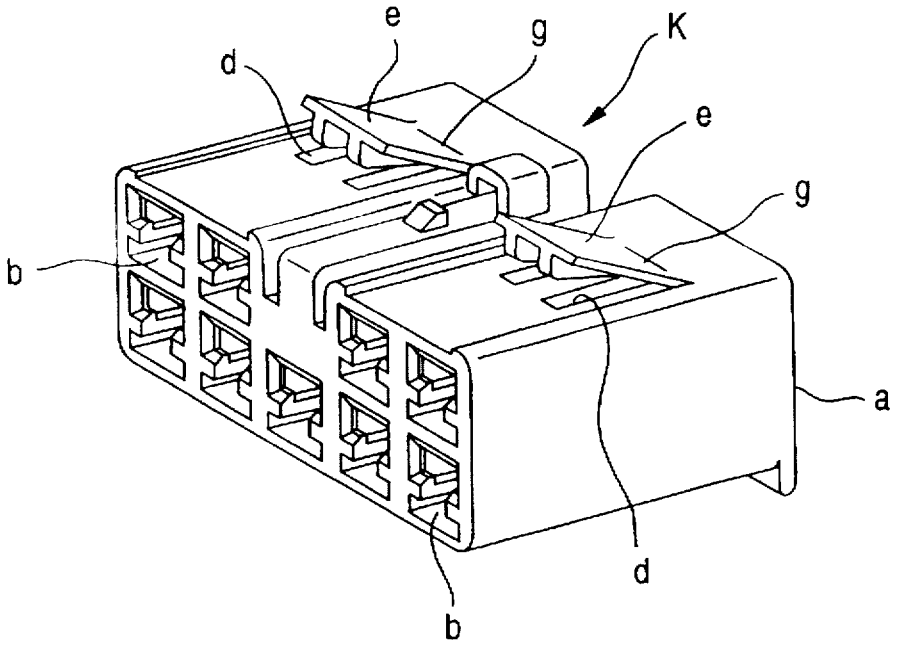
FIG. 10 PRIOR ART
FIG. 10 is a perspective view of a conventional connector housing having retaining plates for retaining terminals against withdrawal.
Figure 11:
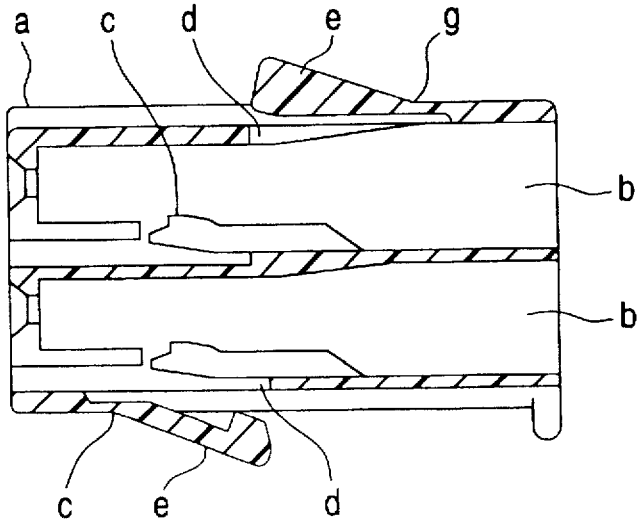
FIG. 11 PRIOR ART
FIG. 11 is a vertical cross-sectional view of the connector housing of FIG. 10.
Figure 12:
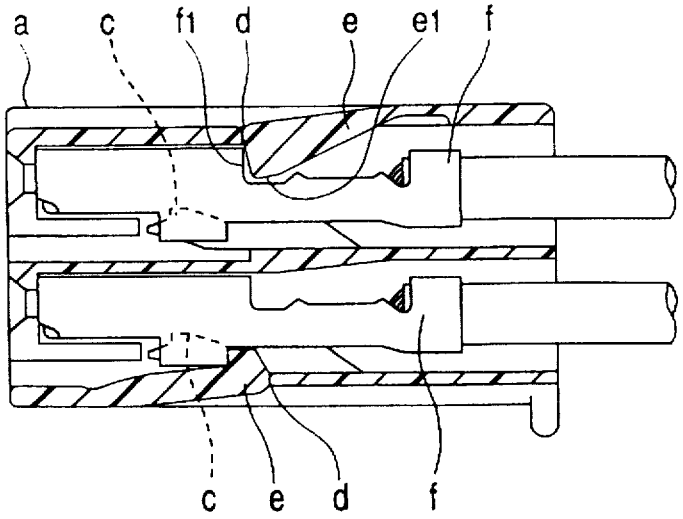
FIG. 12 PRIOR ART
FIG. 12 is a cross-sectional view showing a condition in which terminals are inserted in respective terminal receiving chambers in the connector housing of FIG. 10.

In the above embodiment, although the plurality of retaining holes 6, as well as the plurality of flexible retaining pieces 7, are provided respectively for the terminal receiving chambers 2, there may be provided a connector housing 8 (see FIG. 9) in which there is formed one retaining hole 10 communicating with rear portions of a plurality of terminal receiving chambers 9, and a long flexible retaining piece 11 extends between opposite side edges 10*a* and 10*a'* of the retaining hole 10 so that the terminals, received respectively in the terminal receiving chambers 9, can be retained at a time.

The flexible retaining piece 11, like the above flexible retaining piece 7, has hinges 11*a* and 11*b* formed respectively at opposite ends thereof, and also has a hinge 11 and retaining slanting surfaces 11*c* and 11*c'* at a central portion thereof. When the flexible retaining piece 11 is pressed at its central portion to be introduced into the retaining hole 10, the terminals, received respectively in the terminal receiving chambers, are retained by this flexible retaining piece 11.

In the connector housing of the present invention, the flexible retaining piece can be received into the retaining hole, and when the flexible retaining piece retains the terminal received in the terminal receiving chamber in the connector housing, the flexible retaining piece will not project from the connector housing. Therefore, the flexible retaining piece will not be damaged by an external force, and will not hinder wiring, so that the connector housing can be of a small size, and besides even if an external force acts on the projected flexible retaining piece when fitting the connector housing relative to a mating connector, the flexible retaining piece will not be further raised, and hence will not be damaged.

If any terminal is in a half-inserted condition, the flexible retaining piece can not be fully received into the retaining hole, and the connector housing can not be fitted relative to the mating connector, so that such a half-inserted condition of the terminal can be easily found. Where the plurality of retaining holes are provided respectively for the terminal receiving chambers, and the flexible retaining piece is provided for each of the retaining holes, any terminal receiving chamber in which the terminal is half inserted can be easily found. Thus, these advantages can be achieved.

What is claimed is:

1. An electrical connector, comprising:

a housing;

a terminal receiving chamber formed in said housing to receive a terminal;

a lance formed in said terminal receiving chamber to retain the terminal;

a retaining hole formed through an outer wall of said housing; and a flexible retaining piece connected between opposite side edges of said retaining hole extending substantially parallel to said terminal receiving chamber, said flexible retaining piece being bendable at a central hinge disposed parallel to said terminal receiving chamber at a central portion of said flexible retaining piece and at side hinges respectively disposed parallel to said terminal receiving chamber at the opposite side edges, said flexible retaining piece inserted into said terminal receiving chamber through said retaining hole.

2. The connector of claim 1, wherein the flexible retaining piece has a pair of opposed, retaining slanting surfaces formed respectively on opposite sides of the central hinge.

3. The connector of claim 1, wherein said retaining hole is formed through an outer wall of said terminal receiving chamber.

4. The connector of claim 1, wherein the flexible retaining piece is integrally formed with said housing.

5. The connector of claim 1, wherein the flexible retaining piece includes a pair of surfaces which are in physical contact when the flexible retaining piece is in a locked state and which are separated when the flexible retaining piece is in an unlocked state.

6. An electrical connector, comprising:

a housing;

terminal receiving chambers formed in said housing to receive respectively terminals;

lances formed respectively in said terminal receiving chambers to retain the terminals;

a retaining hole formed through an outer wall of said housing; and a flexible retaining piece connected between opposite side edges of said retaining hole extending substantially parallel to said terminal receiving chambers, said flexible retaining piece being bendable at a central hinge disposed parallel to said terminal receiving chambers at a central portion of said flexible retaining piece and at side hinges respectively disposed parallel to said terminal receiving chambers at the opposite side edges, said flexible retaining piece inserted into each one of said terminal receiving chambers through said retaining hole.

7. The connector of claim 6, wherein the flexible retaining piece has a pair of opposed, retaining slanting surfaces formed respectively on opposite sides of the central hinge.

8. The connector of claim 6, wherein said retaining hole is formed to communicate each of said terminal receiving chambers.

9. The connector of claim 6, wherein the flexible retaining piece is integrally formed with said housing.

10. The connector of claim 6, wherein the flexible retaining piece includes a pair of surfaces which are in physical contact when the flexible retaining piece is in a locked state and which are separated when the flexible retaining piece is in an unlocked state.

* * * * *